US005979791A

United States Patent [19]

Kuykendal et al.

[11] Patent Number: 5,979,791

[45] Date of Patent: Nov. 9, 1999

[54] INTERMITTANT WATER JET

[76] Inventors: Robert L. Kuykendal; Ronald S. Deichmann, both of 1136 Washington, St. Louis, Mo. 63101

[21] Appl. No.: 08/980,666

[22] Filed: Dec. 1, 1997

[51] Int. Cl.[6] ..... B05B 1/08

[52] U.S. Cl. ..... 239/99; 239/16; 239/101; 239/140; 239/273; 239/282; 239/321; 251/28; 251/62

[58] Field of Search ..... 239/16, 17, 19, 239/99, 101, 140, 273, 280.5, 282, 321; 251/28, 30.01, 31, 62, 63; 248/291.1

[56] References Cited

U.S. PATENT DOCUMENTS

| | | | |
|---|---|---|---|
| 3,162,407 | 12/1964 | Yax | 248/291.1 X |
| 3,520,477 | 7/1970 | Cooley | 239/101 |
| 3,847,336 | 11/1974 | Morris et al. | 248/291.1 X |
| 4,863,101 | 9/1989 | Pater et al. | 239/101 X |
| 4,955,540 | 9/1990 | Fuller et al. | 239/280.5 X |
| 5,160,086 | 11/1992 | Kuykendal et al. | 239/273 X |

*Primary Examiner*—Andres Kashnikow
*Assistant Examiner*—Robin O. Evans
*Attorney, Agent, or Firm*—Henry W. Cummings

[57] ABSTRACT

In accordance with the present invention a method and apparatus for forming and launching a slug of liquid toward a designated target area includes a hollow chamber located on a desired incline having a lower liquid inlet and an upper exit orifice, which is preferably a knife edged orifice, in the upper surface of the chamber. A plug-stopper is located on the inner surface of the chamber which is movable between an engaged position blocking flow of liquid through the orifice and and a disengaged position allowing liquid to exit through the orifice. A pistion located within an operating cylinder has a piston rod which extends through the chamber and engages the plug-stopper and moves the plug-stopper between engaged and disengaged positions with the orifice. The piston is moved back and forth by a fluid moving the piston head in the cylinder back and forth. Preferably a stop is provided in the chamber which the stopper plug engages in the orifice disengaged position. Preferably diffuser material is provided in the chamber to reduce turbulance of the liquid prior to it exiting through the orifice. In one embodiment the stop is located on a plate holding the diffuser material in place. A fluid control is provided to control flow of fluid through the cylinder and is preferably provided with adjustments to control the time sequence and extent of movement of the piston. Preferably a trunion is provided to vary the inclination and direction of the chamber. When the piston moves the plug stopper from the engaged position with the orifice to the disengaged positon, liquid exits from the chamber in the form of a liquid slug in a selected direction based on the inclination and direction of the chamber.

21 Claims, 6 Drawing Sheets

INTERMITTANT WATER JET

I. FIELD OF THE INVENTION

This invention relates to a method and apparatus for use in a water fountain for launching a lug of water on a trajectory to a designated target area.

II. BACKGROUND OF THE INVENTION

U.S. Pat. No. 5,160,086 discloses an apparatus for forming a laminar flow liquid stream from a chamber having a knife edge orifice and diffuser material in the chamber through which the liquid flows before reaching the knife edge orifice.

However this apparatus does not include apparatus for forming a liquid slug instead of a laminar liquid stream.

III. SUMMARY OF THE INVENTION

A. Objects of the Invention

One object of the present invention is to provide a method for forming a liquid slug which may be directed toward a designated target area.

Another object of the present invention is to provide an apparatus for forming a liquid slug which may be directed toward a designated target area.

Another object is to provide structure for location of the apparatus in a fountain, river, lake or amuesment park.

Other objects will be apparent from the following Description and Drawings.

B. Summary

In accordance with the present invention a method and apparatus for forming and launching a slug of liquid toward a designated target area includes a hollow chamber located on a desired incline having a lower liquid inlet and an upper exit orifice, which is preferably a knife edged orifice, in the upper surface of the chamber. A plug-stopper is located on the inner surface of the chamber which is movable between an engaged position blocking flow of liquid through the orifice and and a disengaged position allowing liquid to exit through the orifice. A piston located within an operating cylinder has a piston rod which extends through the chamber and engages the plug-stopper and moves the plug-stopper between engaged and disengaged positions with the orifice. The piston is moved back and forth by a fluid moving the piston head in the cylinder back and forth. Preferably a stop is provided in the chamber which the stopper plug engages in the orifice disengaged position. Preferably diffuser material is provided in the chamber to reduce turbulance of the liquid prior to it exiting through the orifice. In one embodiment the stop is located on a plate holding the diffuser material in place. A fluid control is provided to control flow of fluid through the cylinder and is preferably provided with adjustments to control the time sequence and extent of movement of the piston. Preferably a trunion is provided to vary the inclination and direction of the chamber. When the piston moves the plug stopper from the engaged position with the orifice to the disengaged positon, liquid exits from the chamber in the form of a liquid slug in a selected direction based on the inclination and direction of the chamber.

IV THE DRAWINGS

V DESCRIPTION OF PREFERRED EMBODIMENTS

Figure 1:
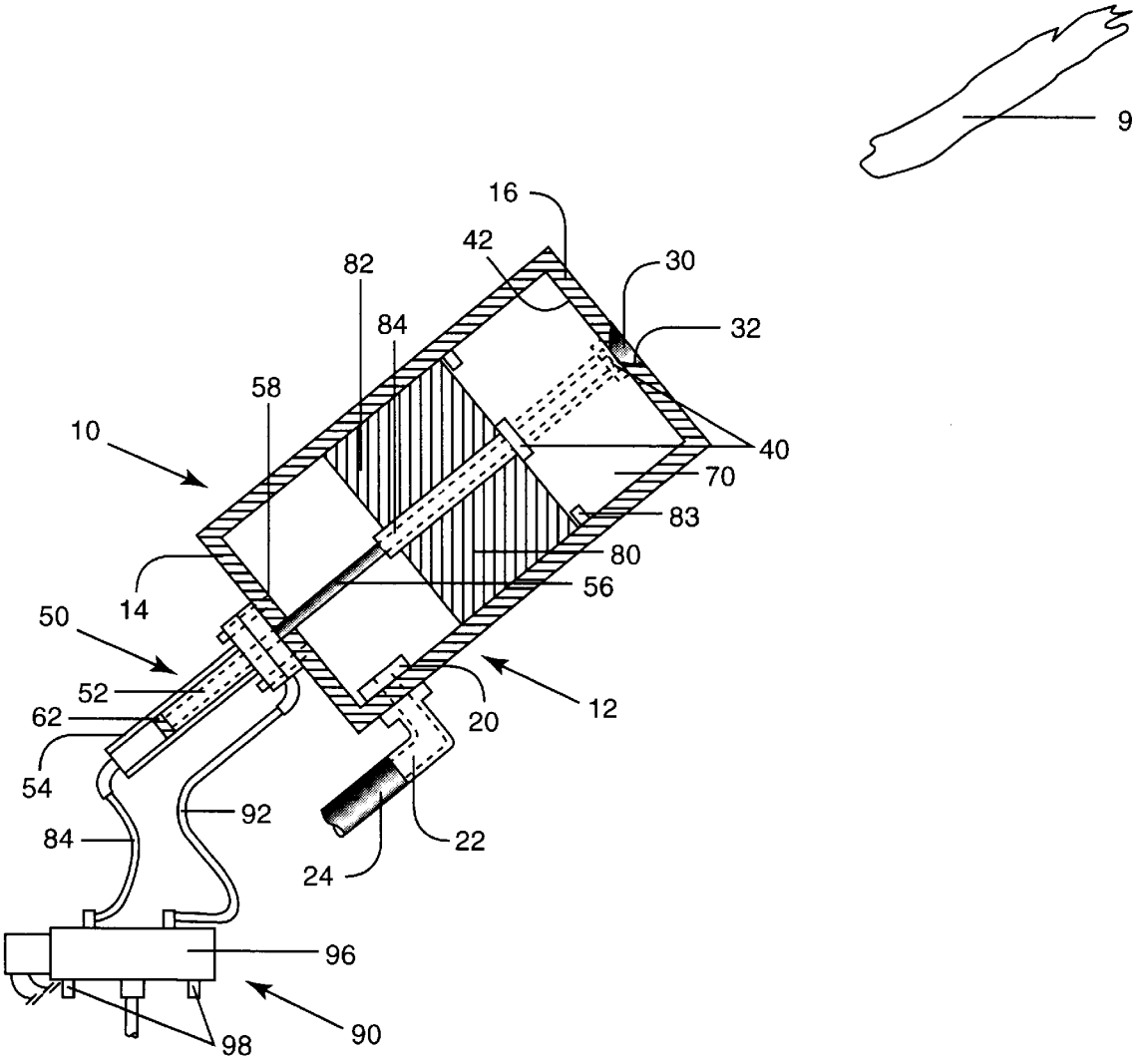
FIG. 1 is a schematic side elevation view illustrating a portion of the method and apparatus of the present invention.
Figure 2:
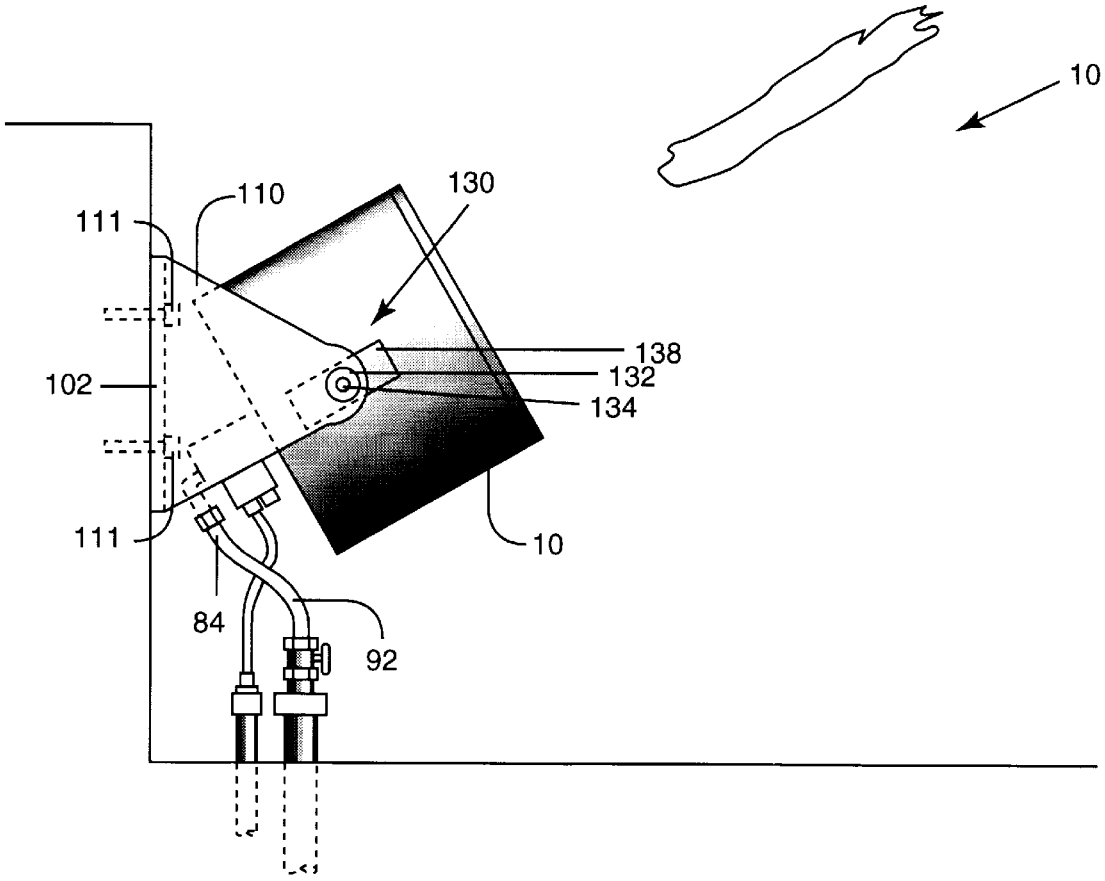
FIG. 2 is a side elevation view illustrating apparatus for changing the orientation of the chamber body of the present invention.
Figure 3:
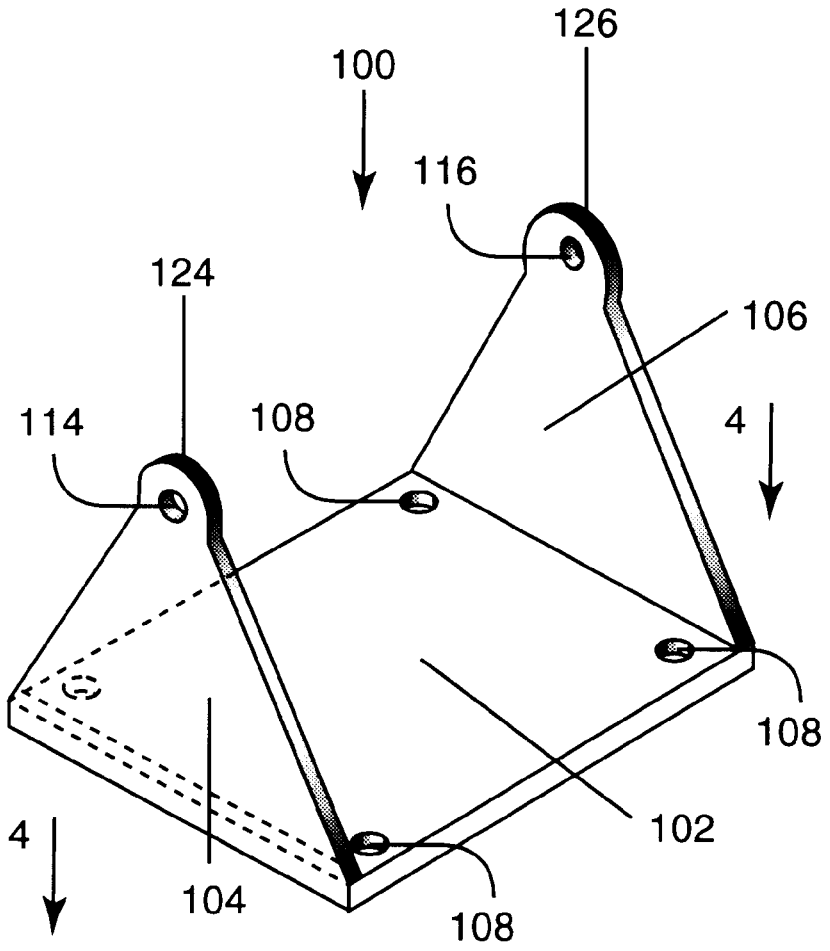
FIG. 3 is a detail perspective view illustrating apparatus for changing the orientation of the chamber body of the present invention.
Figure 4:
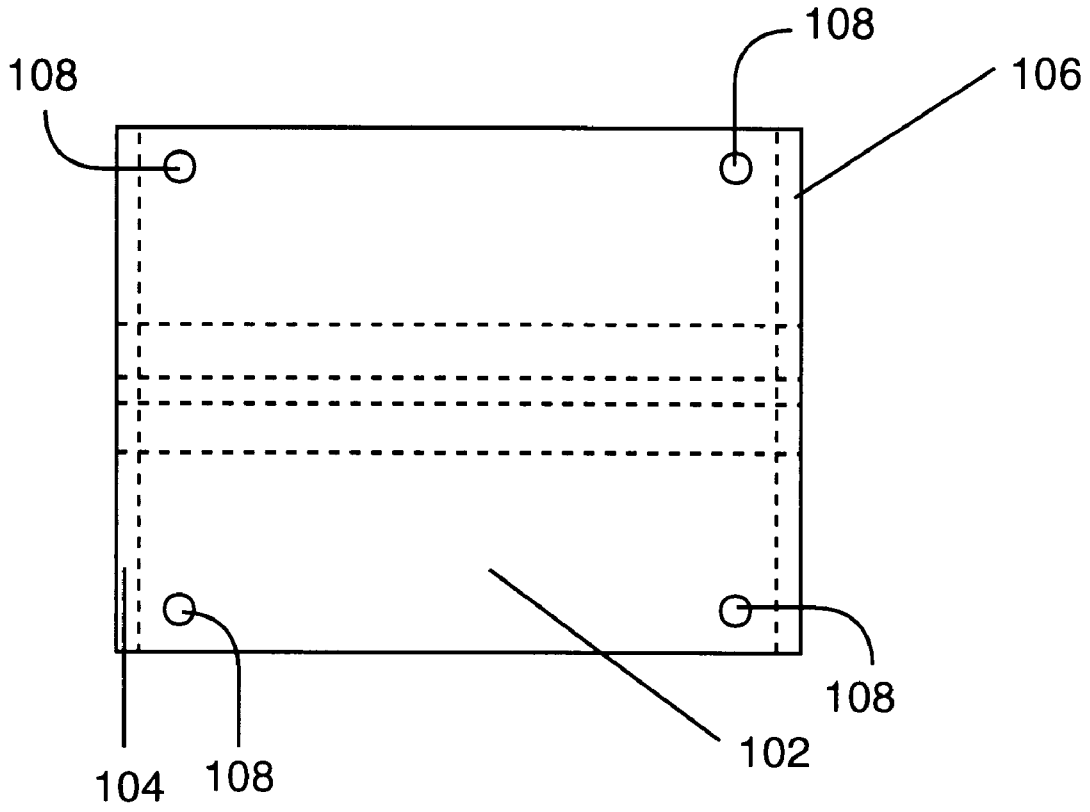
FIG. 4 is a detail sectional view illustrating apparatus for changing the orientation of the chamber body of the present invention looking in the direction of the arrows along the line 4—4 in FIG. 3.

In accordance with the present invention a method and apparatus for forming and launching a slug of liquid toward a designated target area includes a hollow chamber 10 defined by walls 12, 14, and 16 located on a desired incline angle 0. The chamber 10 has a lower liquid inlet 20 through a pipe t 22 from a conduit 24, and an upper exit orifice 30, which preferably has a knife edge opening 32, in the upper wall 16 of the chamber. A plug-stopper 40 is located on the inner surface 42 of the wall is movable between an engaged position blocking flow of liquid through the orifice 32 shown dotted in FIG. 1, and and a disengaged position shown in solid lines in FIG. 1 allowing liquid to exit through the orifice 30.

Means 50 for moving the plug-stopper between engaged and disengaged positions in one embodiment includes a pistion 52 located within an operating cylinder 54. The piston 52 has a piston rod 56 which extends through an opening 58 into the chamber 10 and engages the plug-stopper 40 and moves the plug-stopper 40 between engaged and disengaged positions with the orifice 30. The piston 52 is moved back and forth by a fluid moving the piston head 62 in the cylinder 54 back and forth.

Preferably stop means 70 is provided in the chamber 10 which the stopper plug 40 engages in the orifice disengaged position shown in solid lines in FIG. 1.

Preferably diffuser means 80 is provided in the chamber 10 to reduce turbulance of the liquid prior to it exiting through the orifice 30. The diffuser means may comprise one or more of the materials 82 described in U.S. Pat. No. 5,160,086 hereby incorporated into the present application by this reference. In one embodiment the diffuser material is held in place with a hollow plate 83 welded to the wall 12. Diffuser means 80 includes a generally central opening 84 to allow the piston rod 56 to move back and forth through the diffuser material 82.

In one embodiment the stop means 70 comprises the upper external surface 86 of the diffuser means material 82, located radially inwardly from the plate 83 holding the diffuser material in place. The stop means may also comprise a plate 87 holding the diffuser material in place and having an opening 88 through which the piston rod 56 passes. The stop 40 has a larger diameter than the opening 88.

Fluid control means 90 including conduits 92 and 94 extending between control cylinder 96 and operating cylinder 54 for flow of operating fluidthrough the cylinder 54. The cylinder 96 is preferably provided with adjustments 98 to control the time sequence and extent of movement of the piston 52. The piston cycle may vary widely from about 0.05 seconds to 5 seconds.

Preferably inclination adjustment means 100 is provided to vary the inclination of the chamber. As shown in FIGS. 2–5, this inclination adjustment means comprises a base plate 102 and arms 104 and 106 for example of triangle shape integrally connected thereto for example by welding, or it may be a formed part, for example a forging. The base plate 102 has openings to connect the base plate to a wall W with mechanical fasteners for example screws 110 extending into threaded openings 111 in wall W. The arms 104 and 106 have respective openings in their triangle apexes 124 and 126. Removable fastening means 130 for example nuts 132 and bolts 134 extending into openings 138 in the chamber body 10, hold the chamber body 10 at a desired inclination. This inclination may be varied as desired by unloosening the fastening means 130, rotating the chamber body 10 to a different inclination and re-tightening the fastening means 130.

Figure 5:
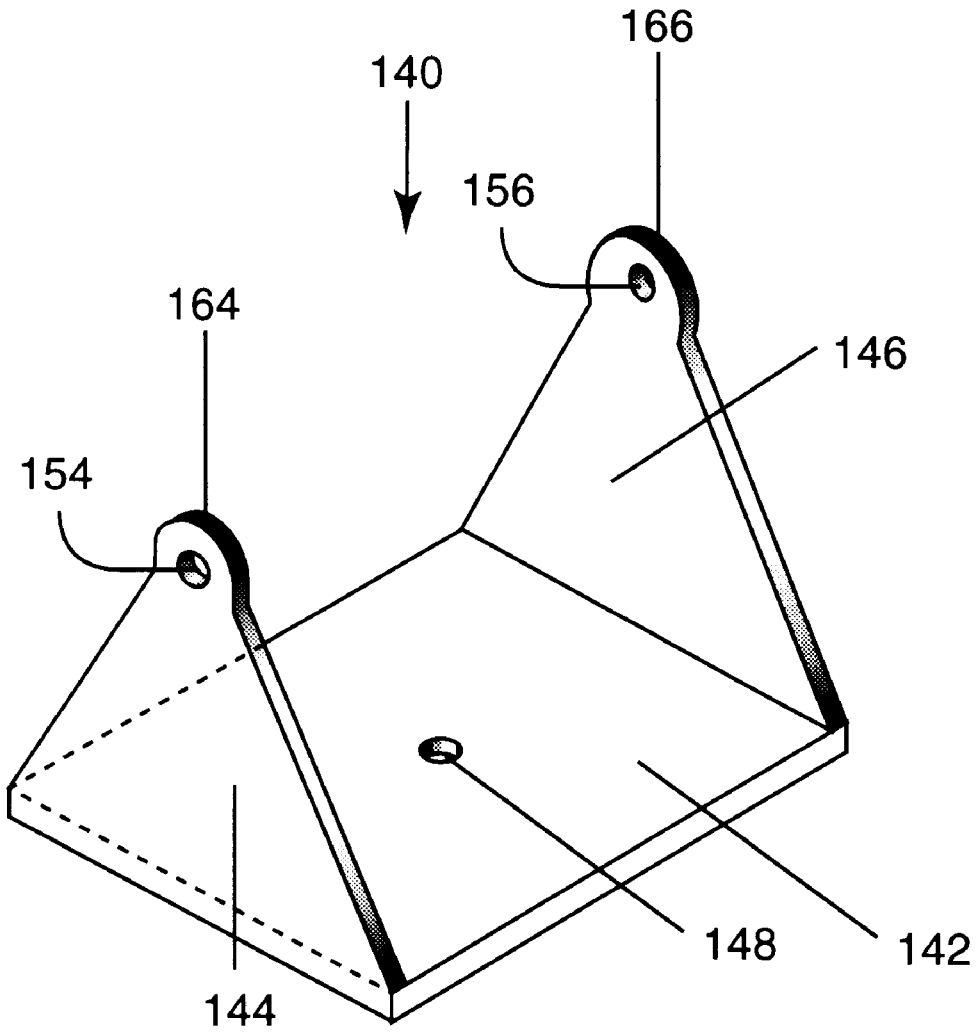
FIG. 5 is a detail perspective view illustrating apparatus for changing the direction or azimuth orientation of the chamber body of the present invention looking in the direction.
Figure 6:
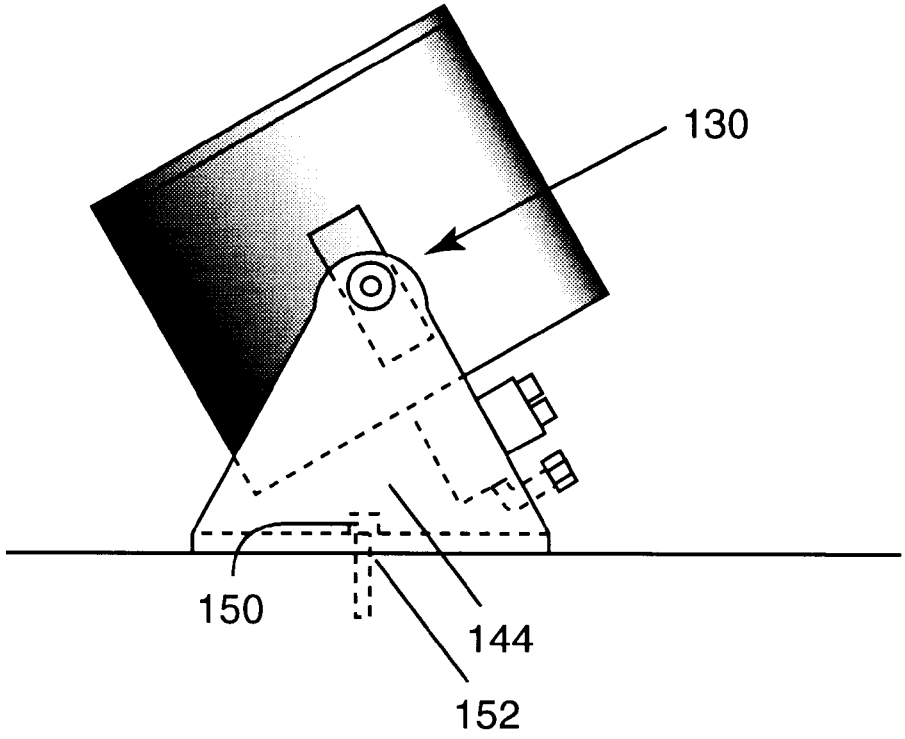
FIG. 6 is a side elevation view illustrating apparatus for changing the direction or azimuth orientation of the chamber body of the present invention.

Means for varying the direction or azimuth are shown in FIGS. 5 and 6 at 140. This means may comprise an opening 148 in base plate to receive a removable fastener such as a screw 150 which is inserted at a desired orientation in a threaded opening 152 in wall W. The arms 144 and 146 conveniently triangular are again provided with openings 154 and 156 in apexes 164 and 166.

Removable fastening means 130 may be inserted into openings 154 and 156 to vary the inclination of the chamber body 10 as described above in connection with FIGS. 2–4. Thus both the inclination and the direction of the chamber body 10 may be varied in accordance with the present invention.

In operation, after the direction and inclination is set, when the piston 52 moves the plug stopper 40 from the engaged position with the orifice shown in dotted lines in FIG. 1 to the disengaged positon, shown in solid lines in FIG. 1, liquid exits from the chamber 10 in the form of a liquid slug S in a selected direction based on the inclination and direction set in trunnion 100.

What is claimed is:

1. An apparatus for forming and launching a slug of liquid toward a designated target area comprising:

a hollow chamber;

mounting means for mounting said chamber in a fountain, river, lake or amusement park;

said mounting means including means for locating said chamber on a vertical incline;

said chamber having a lower liquid inlet and an upper exit orifice located in an upper surface of the chamber;

diffuser material provided in said chamber to reduce turbulance of the liquid prior to it exiting through said orifice;

a plug-stopper having an essentially constant cross section located on the inner surface of said orifice;

a piston rod integrally connected to said plug stopper;

said piston rod having an essentially constant cross section which extends through said chamber; and control means for moving said piston rod and said plug-stopper between an engaged position blocking flow of liquid through said orifice; and a disengaged position allowing liquid to exit through said orifice in the form of a liquid slug from said chamber.

2. Apparatus according to claim 1 wherein said control means comprises a piston located within an operating cylinder; and said piston is connected to said piston rod which extends through said chamber and engages said plug-stopper.

3. Apparatus according to claim 2 wherein said piston includes a piston head and said piston is moved back and forth by a fluid moving the piston head in the cylinder back and forth.

4. Apparatus according to claim 3 wherein said control means to control the extent of movement of said plug-stopper comprises stop means which said stopper-plug engages in said disengaged position.

5. Apparatus according to claim 4 wherein said stop means are located in said chamber.

6. Apparatus according to claim 5 wherein said orifice is a knife edged orifice.

7. Apparatus according to claim 6 wherein said stop means is located on said diffuser material.

8. Apparatus according to claim 6 wherein said stop means are located on a plate holding the diffuser material in place.

9. Apparatus according to claim 6 wherein said stop means are located adjacent said diffuser material.

10. Apparatus according to claim 9 including means for orientating said chamber in a selected direction.

11. Apparatus according to claim 10 including means for orientating said chamber in a selected inclination.

12. Apparatus according to claim 11 wherein the means for orientating said chamber in a selected inclination comprise spaced arms having mounting openings therin and removable mechanical fasteners to hold said chamber at a selected inclination between said spaced arms.

13. Apparatus according to claim 12 wherein the means for orientating said chamber in a selected direction comprise a base plate extending between said spaced arms having a base plate opening and removable fastening means extending through said base plate opening to orient said base plate and chamber in a selected direction.

14. Apparatus according to claim 11 wherein said control means is provided with means to control the time sequence of movement of said plug-stopper.

15. Apparatus according to claim 14 wherein said control means is provided with means to control the extent of movement of said plug-stopper.

16. Apparatus according to claim 2 including means for orientating said chamber in a selected inclination are provided.

17. Apparatus according to claim 16 including means for orientating said chamber in a selected direction.

18. Apparatus according to claim 4 wherein said orifice is a knife edged orifice.

19. A method for forming and launching a slug of liquid comprising:

providing a hollow chamber;

locating said chamber on a support located in a fountain, river, lake or amusement park;

providing said support with a vertical inclination;

providing said chamber with a lower liquid inlet and locating an upper exit orifice in an upper surface of the chamber;

locating diffuser material in said chamber to reduce turbulance of the liquid prior to it exiting through said orifice;

locating a plug-stopper on an inner surface of the chamber;

providing said plug-stopper with an essentially constant cross section;

forming a piston rod with an essentially constant cross section;

extending said piston rod through said chamber to engage said plug-stopper;

integrally connecting said piston rod to said plug-stopper;

moving said plug-stopper between an engaged position blocking flow of liquid through said orifice; and a disengaged position allowing liquid to exit through said orifice in the form of a liquid slug from said chamber.

20. A method according to claim 19 including providing a knife edge said orifice, and locating said stop means adjacent said diffuser material.

21. A method according to claim 19 including locating a piston within an operating cylinder; and connecting said piston to said piston rod.

* * * * *